US006350206B1

(12) United States Patent
Lambert, II

(10) Patent No.: US 6,350,206 B1
(45) Date of Patent: Feb. 26, 2002

(54) GOLF CLUB GRIP ASSIST DEVICE

(76) Inventor: Lahman D. Lambert, II, 14 Kitszell Dr., Carlisle, PA (US) 17013

( * ) Notice: Subject to any disclaimer, the term of this patent is extended or adjusted under 35 U.S.C. 154(b) by 0 days.

(21) Appl. No.: 09/528,596

(22) Filed: Mar. 20, 2000

Related U.S. Application Data

(60) Provisional application No. 60/130,982, filed on Apr. 26, 1999.

(51) Int. Cl.[7] ..... A63B 57/00

(52) U.S. Cl. ..... 473/205; 473/206; 473/212; 473/213; 473/276

(58) Field of Search ..... 473/201, 202, 473/203, 204, 205, 206, 212, 213, 276, 549, 568

(56) References Cited

U.S. PATENT DOCUMENTS 742,004 A * 10/1903 Carnegie
2,234,638 A * 3/1941 Topping
2,273,416 A * 2/1942 Norwood
2,476,489 A * 7/1949 Grandinetti
3,951,416 A * 4/1976 Koch
5,398,930 A 3/1995 Gibson ..... 473/201
5,813,950 A 9/1998 Parker ..... 482/93

* cited by examiner

*Primary Examiner*—Stephen L. Blau

(57) ABSTRACT

A lightweight, portable device to assist one-armed limited humans to simulate a two-handed golf grip that may may have been lost due to a stroke, accident or illness. The device features an arm cuff (10) attached to a golf club shaft tube (12) which extends a sufficient length to encapsulate a majority portion of a golf club handle (28). At the opposite end of the shaft tube 12 is a elastic retaining cord (14) which fits over the wrist of the active arm (26) thereby holding the device snugly to the arm, both at an area around the wrist and at an area around the upper forearm due to the arm cuff. A retaining leaf (22) on the side of the shaft tube acts to help stabilize oscillation of the club handle yet permits easy movement of the club handle either for length of grip positioning or extraction/insertion of a golf club.

4 Claims, 3 Drawing Sheets

Sectional View 2 -2

GOLF CLUB GRIP ASSIST DEVICE

BACKGROUND—Cross Reference to Related Applications

This application claims the benefit of Provisional Patent Application, Serial No. 60/130,982, filed Apr. 26, 1999.

BACKGROUND—Field of Invention

This invention relates to a golf club gripping device for one-armed limited human beings.

BACKGROUND—Discussion of Prior Art

Originally, as a physically disadvantaged individual, I chose to begin playing golf as a way to help rehabilitate myself following a stroke. In my attempt to locate a suitable device to assist me in grasping golf club handle with one hand, I found that nothing existed. Being a retired designer, I again chose to design and build my own device.

In doing patent searches for a like device, my boolean text search netted 20 documents of which I found only two that seemed somewhat related to my invention. The first of these two, U.S. Pat. No. 5,813,950 to Parker (1980), is a grip assist apparatus for weight lifters, but seems ill-suited for gripping a golf club handle due to a lack of a clib shaft support member.

The second patent, U.S. Pat. No. 5,398,930 to Gibson (1995) does provide a club shaft support member, but requires the user of the device to submit to one of two conditions:

(a) The inconvience of the removal and replacement of the device if choosing a different numbered club during play or (b) The added cost of the convience of providing for a full set of the devices for each club in the bag.

In each case, there is either an extra expense of time or money, plus the assumption that two hands are still to be used in gripping the club handle.

OBJECTS AND ADVANTAGES

Accordingly, several objects and advantages of my invention are:

(a) To provide a grip assist device which can simulate a two handed grip for a golfing person who only has the use of one hand.

(b) To provide a grip assist device which will permit fast and easy changing of club selection without the burden of additional adapters.

(c) To provide a grip assist device which can be self applied by the wearer.

(d) To provide a grip assist device that is lightweight and durable.

Further objects and advantages are to provide a grip assist device which supplies additional compressional force inside the shaft tube whereby stabilizing any wobbling motion of the golf club shaft within the shaft tube.

Still further objects and advantages will become apparent from a considerations of the ensuing description and drawings.

DRAWING FIGURES

REFERENCE NUMERIALS IN DRAWINGS

10 Arm Cuff
12 Shaft Tube
14 Elastic Retaining Cord
16 Cushioning Material
18 Longitudinal Through-hole
20 Retaining Leaf Slot
22 Retaining Leaf
24 Arm (reference)
26 Hand (reference)
28 Golf Club Handle (reference)

SUMMARY

In accordance with the present invention the golf club grip assist device comprises a rigid body having a top and bottom tube, a retaining leaf adjacent a slot in the bottom tube and a wrist retaining cord at the front end of the bottom tube.

DESCRIPTION OF INVENTION—FIGS. 1 to 5

Figure 1:
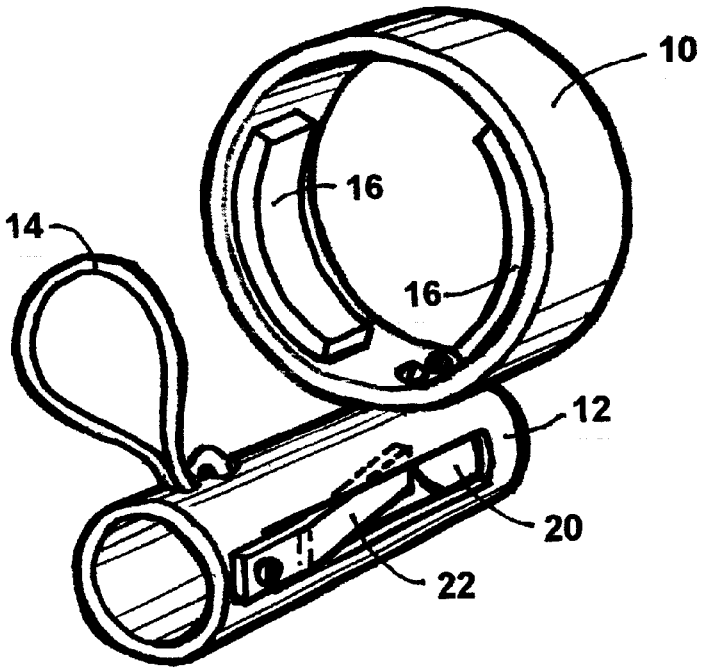
FIG. 1 shows a front perspective view of the golf club grip assist device.
Figure 2:
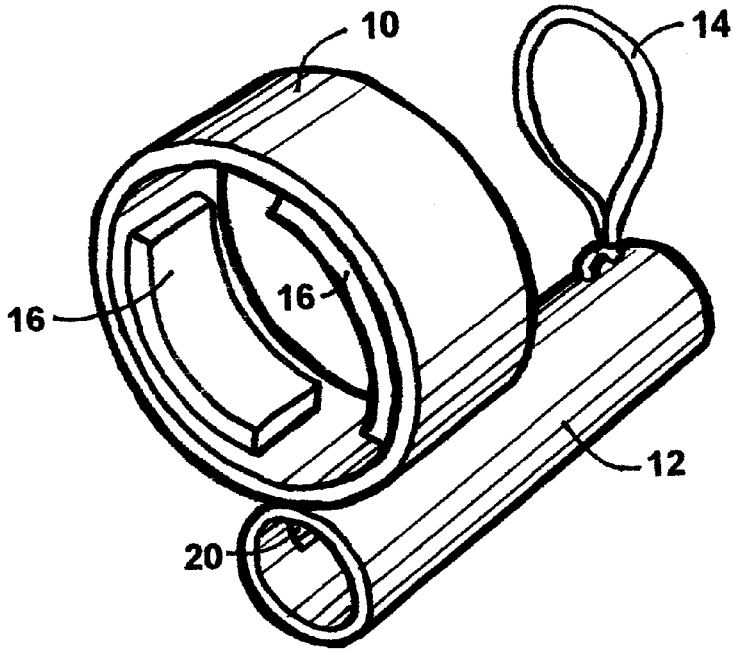
FIG. 2 shows a rear perspective view of the golf club grip assist device.

A typical embodiment of the present invention is illustrated in FIG. 1 (front perspective view) and FIG. 2 (rear perspective view). The body of the device consists of two attached cylindrical pieces, the arm cuff 10 and a shaft tube 12. They are joined together at a point where the shaft tube 12 is extended past and lower than the arm cuff 10. Cushioning material 16 is secured to the interior curved surface of the arm cuff 10 as a matter of comfort and fit when the device is applied to a human arm 24. For additional clarification in FIG. 3 a sectional view (Line 2—2) shows how the elastic retaining cord 14 is fed through the top longitudinal holes 18 near the forward end of the shaft tube 12 and pulled back tightly through itself as a means of securing said cord to said tube. Once it is secured the remaining loop portion of the retaining cord 14 is fitted over the human hand 26 and onto the wrist.

Also shown in FIG. 1 is a retaining leaf 22 that is attached to the outside of the shaft tube 12 but protrudes through the the retaining leaf slot 20 and partway into the interior of said tube but not comimg in contact with the inside surface of said tube.

Figure 3:
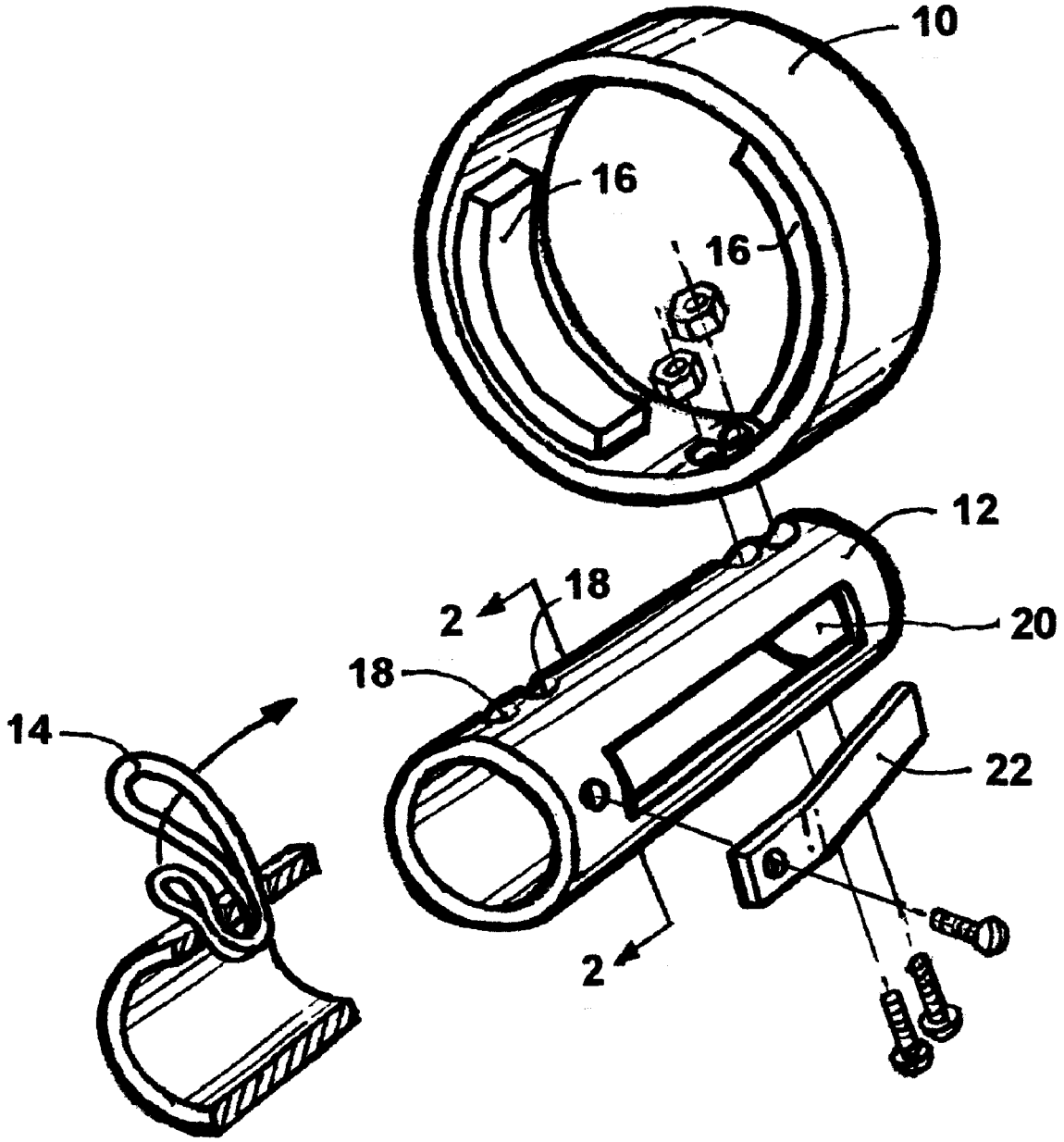
FIG. 3 shows the golf club grip assist device as an exploded view with an additional sectional view (line 2—2) of the front end of shaft tube.

The body can be formed of polyethelene or aluminum material. One method of joining the two cylindrical pieces is by one piece extrusion. The shaft tube may have a plurality of side slots and retaining leafs. The shaft tube may be made to rotate about a central point relative to the arm cuff and locked into an angled or horizontal position to suit a preference of the wearer. The means for joining said shorter tube to said elongated tube as shown in FIGS. 1 and 3 will be either flush or below an inner surface of the arm cuff.

Figure 4:
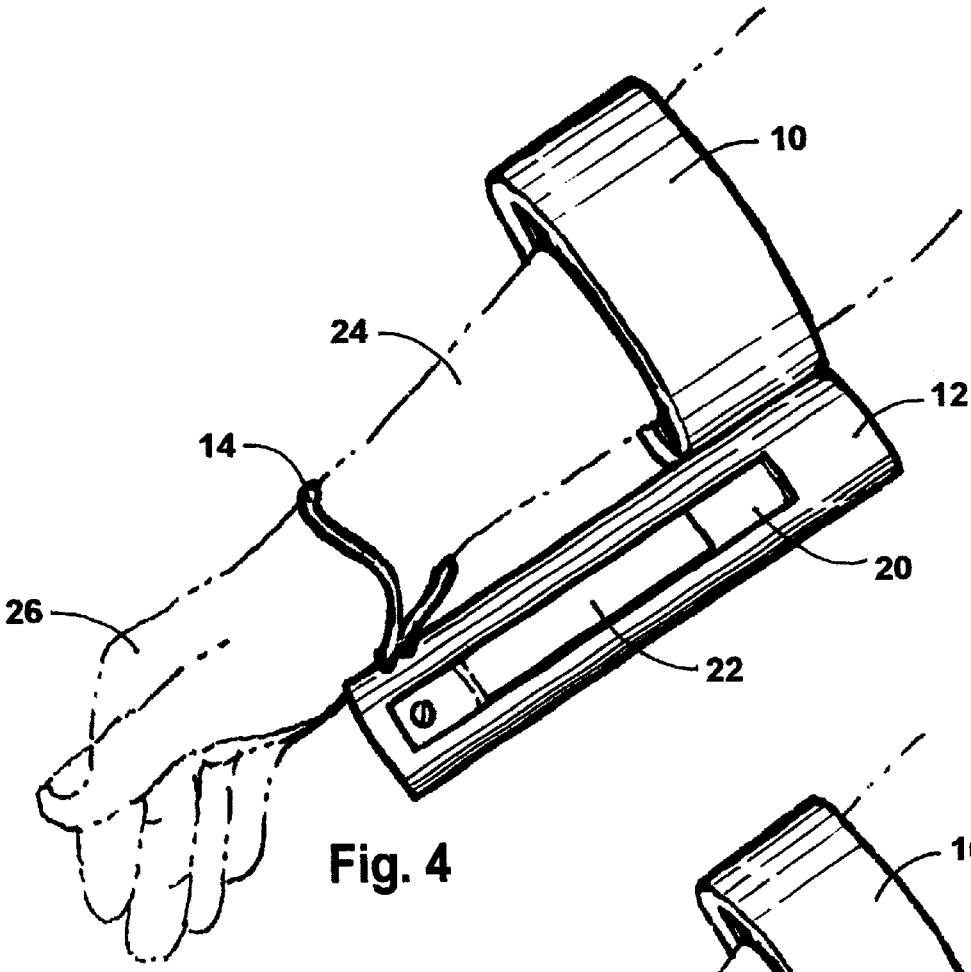
FIG. 4 shows the golf club grip assist device as applied to the arm and wrist.
Figure 5:
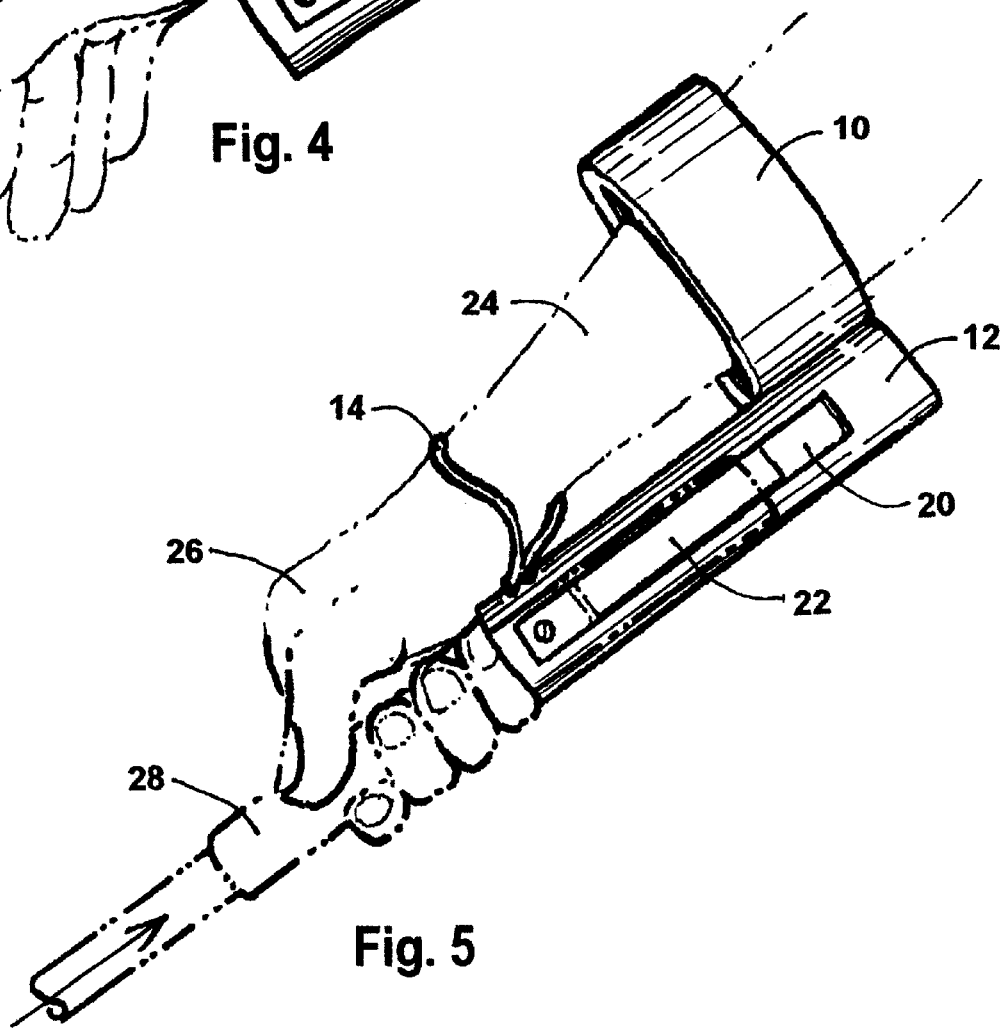
FIG. 5 shows the golf club grip assist device with inserted golf club shaft in the shaft tube.

OPERATION—FIGS. 4 and 5

The manner of using the golf club grip assist device is to first apply it similarly to that of putting a glove over one's hand. Namely, the wearer will insert the "good" hand 26 through the back of the arm cuff 10 and then forward towards the top and front of the shaft tube 12. Once the arm cuff 10 is tightly up against the upper portion of the forearm, the wearer then slips his/her hand 26 through the of the elastic retaining cord 14. This position is illustrated via FIG. 4.

Once the golf club grip assist device is placed on the wearer's arm 24, the wearer then selects a golf club and inserts the golf club's handle 28 into the open end of the shaft tube 12. As the golf club shaft is free to move in and out, tension is automatically applied to the shaft by the retaining leaf 22. After the preferred grip distance (from hand to golf ball location) is chosen, the wearer then simply closes his/her hand 26 on the golf club handle 28. This position is illustrated via FIG. 5.

CONCLUSION, RAMIFICATIONS, AND SCOPE

Accordingly, The reader will see how this device will assist a one-armed limited person in achieving a grip on a golf club handle that simulates a two-handed grip, since the shaft tube mimics the grasping capabilities of an opposing second hands This device has additional advantages that (a) allows it to be used on either right or left arm, (b) can be applied with or without assistance, (c) is lightweight and portable, (d) allows for quick and easy changing of golf club selections, (e) adapts to a wide variety of golf club handle diameters (within the limits imposed by the inside diameter of the shaft tube, and (f) helps reduce hand trauma by minimizing demand on wrist flexing.

Although the description of the above device contains many specificities of the invention, these should not be construed as limiting the scope of the invention but as merely providing illustrations of some of the attributes of this invention. For example, the body of the device could be of different cross-sectional shapes, such as triangular, rectangular, elliptical, or any combination thereof. Also, the body of the device could be produced by way of a one-piece extrusion in lieu of separately joined pieces.

Thus the scope of the invention should be determined by the amended claims and their legal equivalents, rather than by the examples given.

I claim:

1. A golf club grip assist device for one-armed limited players, comprising:

(a) a rigid body including an elongated open ended tube for receiving a handle and a shaft of a golf club whereby said elongated open ended tube having a side slot for a retaining leaf and top slots for a retaining strap;

(b) a shorter open ended tube for insertion of a player's hand and wrist, wherein said shorter tube has a dimensioned area for cushioning material;

(c) said cushioning material, said retaining leaf and said retraining strap being ancillary parts of said rigid body;

(d) means for joining said shorter tube to said elongated tube whereby said means for joining is either flush or below an inner surface of said shorter tube;

(e) cushioning material is secured to said inner surface of said shorter tube; and (f) means for attaching said retaining leaf and retaining strap to said elongated tube whereby said device is for either a player's right or left arm.

2. The golf club grip assist device of claim 1 wherein said body is made of polyethelene tubing.

3. The golf club grip assist device of claim 1 wherein said body is made of aluminum tubing.

4. The golf club grip assist device of claim 1 wherein said means for attaching said retaining leaf is made by way of a self incorporated member.

* * * * *